US005993254A

United States Patent [19]

Pitschi et al.

[11] Patent Number: 5,993,254

[45] Date of Patent: Nov. 30, 1999

[54] CONNECTOR FOR COAXIAL CABLES WITH IMPROVED CONTACT-MAKING BETWEEN CONNECTOR HEAD AND OUTER CABLE CONNECTOR

[75] Inventors: Franz Xaver Pitschi, Rottach-Egern; Werner Wild, Butterwiesen-Unterthürheim, both of Germany

[73] Assignee: Spinner GmbH Elektrotechnische Fabrik, München, Germany

[21] Appl. No.: 09/113,740

[22] Filed: Jul. 10, 1998

[30] Foreign Application Priority Data

Jul. 11, 1997 [DE] Germany ..... 197 29 876

[51] Int. Cl.[6] ..... H01R 9/05

[52] U.S. Cl. ..... 439/584

[58] Field of Search ..... 439/583, 584, 439/85; 174/89

[56] References Cited

U.S. PATENT DOCUMENTS 3,963,321 6/1976 Burger et al. ..... 439/584
4,046,451 9/1977 Juds et al. ..... 439/583
4,421,377 12/1983 Spinner ..... 439/583
5,595,502 1/1997 Allison ..... 439/429

*Primary Examiner*—Neil Abrams
*Assistant Examiner*—Michael C. Zarroli
*Attorney, Agent, or Firm*—Henry M. Feiereisen

[57] ABSTRACT

A connector for a coaxial cable, includes a head portion having a recess which has one end formed with a first ring surface for establishing a contact from inside with an end zone of an outer cable conductor, and a restraint mechanism for the coaxial cable, with the restraint mechanism including a clamp bushing having a head portion side end formed with a second ring surface for clamping the end zone of the outer cable conductor from outside, and a pressure-applying member surrounding the cable and fastened to the head portion. The pressure-applying member forces the clamp bushing in the axial direction against the first ring surface to thereby clamp the end zone of the outer cable conductor between the first and second ring surfaces. In order to effect a particular high degree of contact, at least one of the first and second ring surfaces is formed with at least one annular bead jutting out in the direction of a respective area of the end zone of the outer cable conductor and defined by a height of approximately 5 to 30% of a wall thickness of the outer cable conductor.

15 Claims, 6 Drawing Sheets

FIG. 2
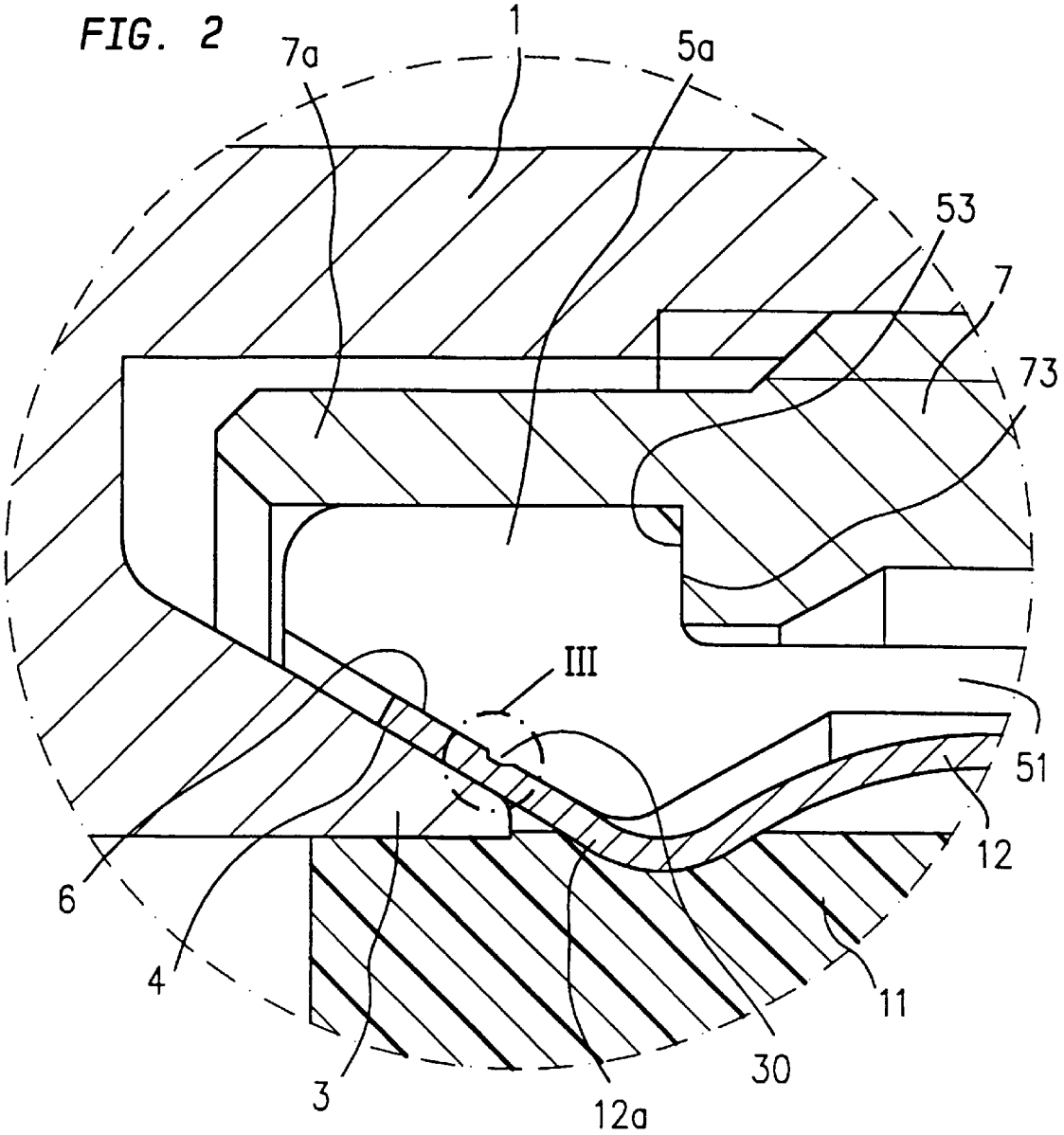
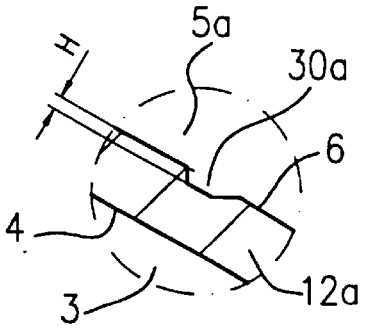
FIG. 3A
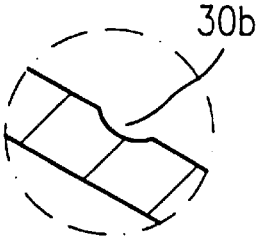
FIG. 3B
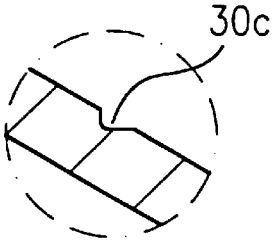
FIG. 3C

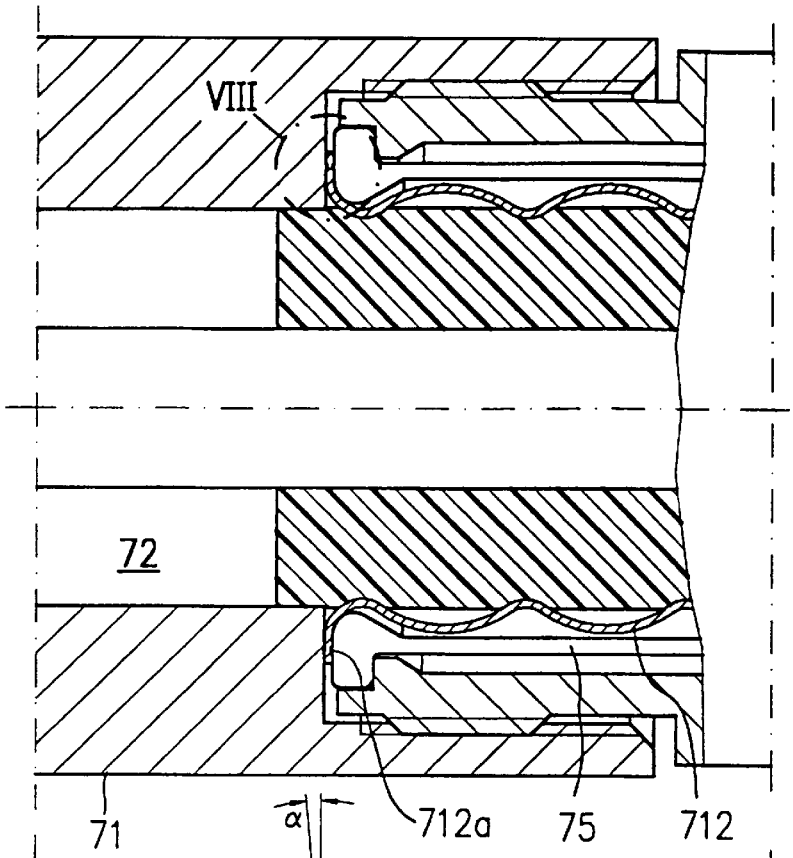
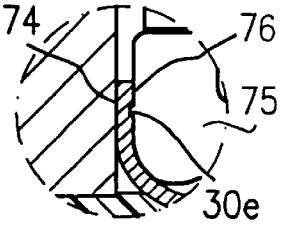
FIG. 8A
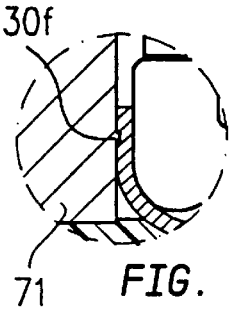
FIG. 8B
FIG. 7
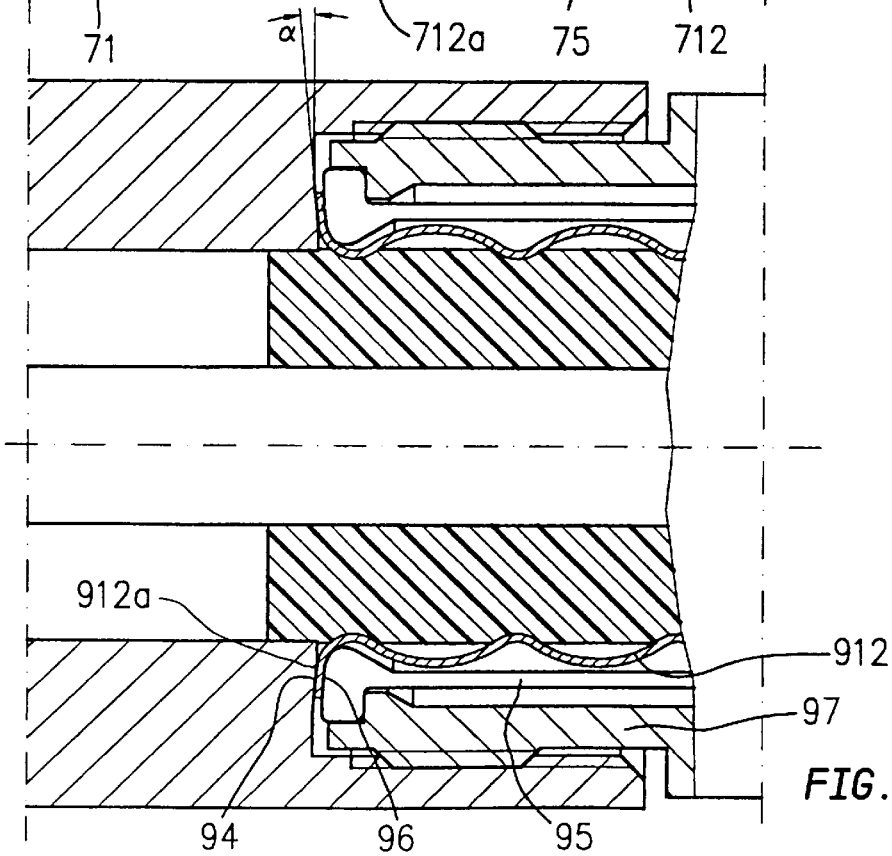
FIG. 9

CONNECTOR FOR COAXIAL CABLES WITH IMPROVED CONTACT-MAKING BETWEEN CONNECTOR HEAD AND OUTER CABLE CONNECTOR

BACKGROUND OF THE INVENTION

The present invention generally relates to a connector for coaxial cables, and in particular to a connector of a type including a head portion having a recess which has one end formed with a first ring surface for establishing a contact from inside with an end zone of an outer cable conductor, and a restraint for the coaxial cable, with the restraint being formed by a clamp bushing having a head portion side end formed with a second ring surface for clamping the end zone of the outer cable conductor from outside, and a pressure-applying member enclosing the cable and fastened to the head portion for forcing the clamp bushing in the axial direction against the first ring surface and to thereby clamp the end zone of the outer cable conductor between the first and second ring surfaces.

Connectors of this type are known for use with coaxial cables having a smooth, possibly foil-like outer conductor as well as for coaxial cables with annular corrugated or helically corrugated outer conductor (compare e.g. German Pat. No. 43 09 775 C2). Heretofore, the intermodulation behavior of such units of connector/coaxial cable was generally satisfactory. More recently, however, the demanded value for the signal-to-intermodulation ratio of connector/coaxial cable units has significantly increased when used in particular for mobile radiotelephone base stations.

Current designs of connectors are not suitable to reach the demanded high intermodulation ratio and in particular to offer an intermodulation ratio that is substantially constant over the service life. In other word, the currently attained contact-making capability is not always satisfactory.

SUMMARY OF THE INVENTION

It is thus an object of the present invention to provide an improved coaxial cable connector, obviating the afore-stated drawbacks.

In particular, it is an object of the present invention to provide an improved coaxial cable connector which exhibits improved contact-making qualities.

These objects, and others which will become apparent hereinafter, are attained in accordance with the present invention by so designing the ring surface of the head portion and the ring surface of the clamp bushing at the head portion side end thereof that at least one of the ring surfaces is formed with at least one annular bead which projects in the direction of a respective area of the end zone of the outer cable conductor and is defined by a height of approximately 5 to 30% of a wall thickness of the outer cable conductor.

The present invention is based on the recognition that intermodulation products are formed even though the contact resistance may not be sufficiently small and constant over the circumference of the ring-shaped contacting zone between the outer cable conductor and the head portion. The resultant demand cannot be satisfied by conventional connectors neither during initial assembly nor during use; the latter also because the obtained, mechanical clamping action is not capable to completely prevent tension forces and pressure forces generated through movement of the coaxial cable and typically propagating into the contacting zone from causing relative movements, though small, between the contacting surfaces.

In accordance with the present invention, both causes resulting in intermodulation products of inadmissible level are eliminated because the at least one annular bead is pushed into the normally relatively soft material, typically of a copper alloy, of the outer cable conductor. The axial force introduced by the pressure-applying member allows material of the outer cable conductor to migrate into the contacting surface until the area of the outer cable conductor contacting the ring surface is of such size that a balance is established between the integral of the surface pressure and the axial force. Thus, the significant wall thickness tolerances of the outer cable conductor are compensated, and apart from the plastic deformation also an elastic partial deformation of the outer conductor material is effected which results in a secure contact-making at contact resistance evenly distributed over the circumference. In addition, as the annular bead is pressed into the outer conductor material, the resultant deformation of the outer conductor material leads to the formation of a pinched edge which is interconnected with the annular bead to provide a form-fitting engagement. As a result, external forces transmitted onto the connection will not cause a relative movement between the contacting components.

Suitably, the first and second ring surfaces may each extend in a radial plane to suit certain types of conventional connector configurations. The first and second ring surfaces may also extend on conical outer surface areas, the respective generatrix of which intersect the longitudinal axis of the connector in a point located on the cable-side of the ring surfaces.

The first and second ring surfaces may describe an angle in the range of greater than 0° to about 5°. Thus, the width of the ring-shaped contacting area is reduced, and at a same time the surface pressure respectively increases at given axial force. Moreover, through selection of the angle, the radial disposition of the contacting surface can be influenced.

According to another feature of the present invention, at least one of the ring surfaces is provided with at least two coaxial annular beads of different diameter so as to improve and even out the contacting. This can be especially suitable in those circumstances in which the material of the outer cable conductor can only be deformed to a limited degree, e.g. in case of a foil-type outer conductor when the height of the annular beads should be kept small.

In the event both ring surfaces are formed with at least one annular bead, it is preferred to provide the annular beads of the first and second ring surfaces of different diameter so as to prevent simultaneous material deformation of the outer cable conductor from opposing sides.

If production reasons dictate, the annular beads may be formed with a cross sectional profile that is free from undercuts when viewed from the side of treatment. Normally, the cross sectional profile of the annular beads is however of secondary importance, although the formation of sharp-edged cross sections should be avoided because of the resultant notch effect.

The contacting quality can further be improved when securing the clamp bushing in the recess of the head portion against rotation while yet allowing an axial displacement thereof. In this manner, the ring surface of the clamp bushing is prevented from rubbing on the respective outer surface of the outer cable conductor when assembling the connector so that scoring and metallic wear is eliminated. For the same reason, the head portion is held in place during assembly of the connector to prevent the same disadvantagous effect between the contacting ring surface of the head portion and the respective region of the outer cable conductor.

The same advantages are attained when securing the clamp bushing against rotation in the area of its head portion side end through provision of a form-fitting engagement with the inner wall of the recess of the head portion.

According to another feature of the present invention that is suitable for coaxial cables with annular corrugated outer cable conductor, the clamp bushing is formed with axial slots extending from its head portion side end for providing resilient tongues, whereby the clamp bushing has at its head portion side end an inner diameter which approximately corresponds to the outer diameter of the outer cable conductor in the region of a wave trough and in the remaining portion has an inner diameter which approximately equals the greatest outer diameter of the outer cable conductor. The width of the axial slots should be kept as small as possible as the slots interrupt the clamping area. The more important contacting area is however between the first ring surface and the inside of the outer cable conductor because it effects the direct contact of the outer cable conductor and the head portion. Thus, this contacting area remains uninterrupted. During the course of assembly of the connector, the clamp bushing is initially placed over the outer cable conductor which has been freed from its insulation, whereby the resilient tongues expand accordingly. The assembly of the connector is thus considerably simplified compared to the application of a conventional clamp bushing that has an inner contour corresponding to the outer contour of the outer cable conductor and is split in two halves to allow installation.

When used for a coaxial cable with helically corrugated outer cable conductor, the clamp bushing may be formed as a conventional profiled corrugated tubular nut which is simply screwed onto the outer conductor during initial phase of the assembly.

Preferably, the pressure-applying member is formed as a hollow screw turned into the recess of the head portion and at least partially overlapping the clamp bushing.

The hollow screw may be formed at its head portion side end with a ring-shaped end face or a radially inwardly extending annular shoulder which is in form-fitting engagement with an annular shoulder which projects radially outwards from the outer circumference of the clamp bushing in proximity of its head portion side end. The provision of a hollow screw with ring-shaped end face that presses against a respective annular shoulder of the clamp bushing is sufficient when the forward head portion side end of the clamp bushing bears upon the inner wall of the recess of the head portion and is thereby secured from springing open in radial direction in the clamping region. This configuration is necessary for effecting the required surface pressure in the contacting region especially when the ring surfaces lie on conical outer surface areas. In the event, the inner diameter of the recess of the head portion in the contacting region significantly exceeds the outer diameter of the clamp bushing in this same region, the required support of the outer circumference of the clamp bushing is ensured by a prolongation of the hollow screw (or of another type of pressure-applying member) beyond the radially inwardly projecting annular shoulder, especially when the clamp bushing is formed with resilient tongues for mounting onto an annular corrugated outer cable conductor.

This embodiment can be further modified by providing a force-transmitting ring of wear-resistant material between the ring-shaped end face or the inwardly projecting annular shoulder of the hollow screw and the outwardly extending annular shoulder of the clamp bushing. This ring prevents the pressure-applying member, especially when configured in the form of a hollow screw, from conjointly moving the clamp bushing during installation that could lead to the undesired furrow and rubbing action, as stated above if the clamp bushing is not secured against rotation. It will be appreciated by persons skilled in the art that the ring positioned between the force-transmitting components of the hollow screw and the clamp bushing represents only an additional safety mechanism since the force conditions prevalent between the components initially moving relative to one another during tightening of the hollow screw normally effect without provision of an anti-rotation mechanism that the clamp bushing can only be shifted in axial direction but not in rotational direction.

BRIEF DESCRIPTION OF THE DRAWING

The above and other objects, features and advantages of the present invention will now be described in more detail with reference to the accompanying drawing in which:

FIG. 2 is a cutaway view, on an enlarged scale, of a detail designated by II in FIG. 1 of the coaxial cable connector;

FIG. 3*a* is a cutaway view, on an enlarged scale, of a detail designated III in FIG. 2, illustrating a section of the contacting region of the outer cable conductor;

FIGS. 3*b*, 3*c* are enlarged, partially sectional views, similar to FIG. 3*a*, of modified configurations of the contacting region;

FIG. 7 is a longitudinal section of a third embodiment of a coaxial cable connector according to the present invention;

FIGS. 8*a*, 8*b* are cutaway views, on an enlarged scale, of two variations of the contacting area designated by circle VIII in FIG. 7;

FIG. 9 is a longitudinal section of a modification of the coaxial cable connector of FIG. 7;

DETAILED DESCRIPTION OF PREFERRED EMBODIMENTS

In the following description and foregoing figures only those components of a coaxial cable connector are referred to that are relevant for the understanding of the present invention. Thus, the figures do not show and the following description does not refer in particular to the configuration of the plug side of the coaxial cable connector as well as to details of the connection between the inner conductor of the connector and the inner cable conductor, such as e.g. a plug pin. Moreover, it is to be understood that the principles described in the following description with respect to a coaxial cable connector are generally applicable to e.g. a male portion or plug or to a female portion or socket or to other similar elements.

Figure 1:
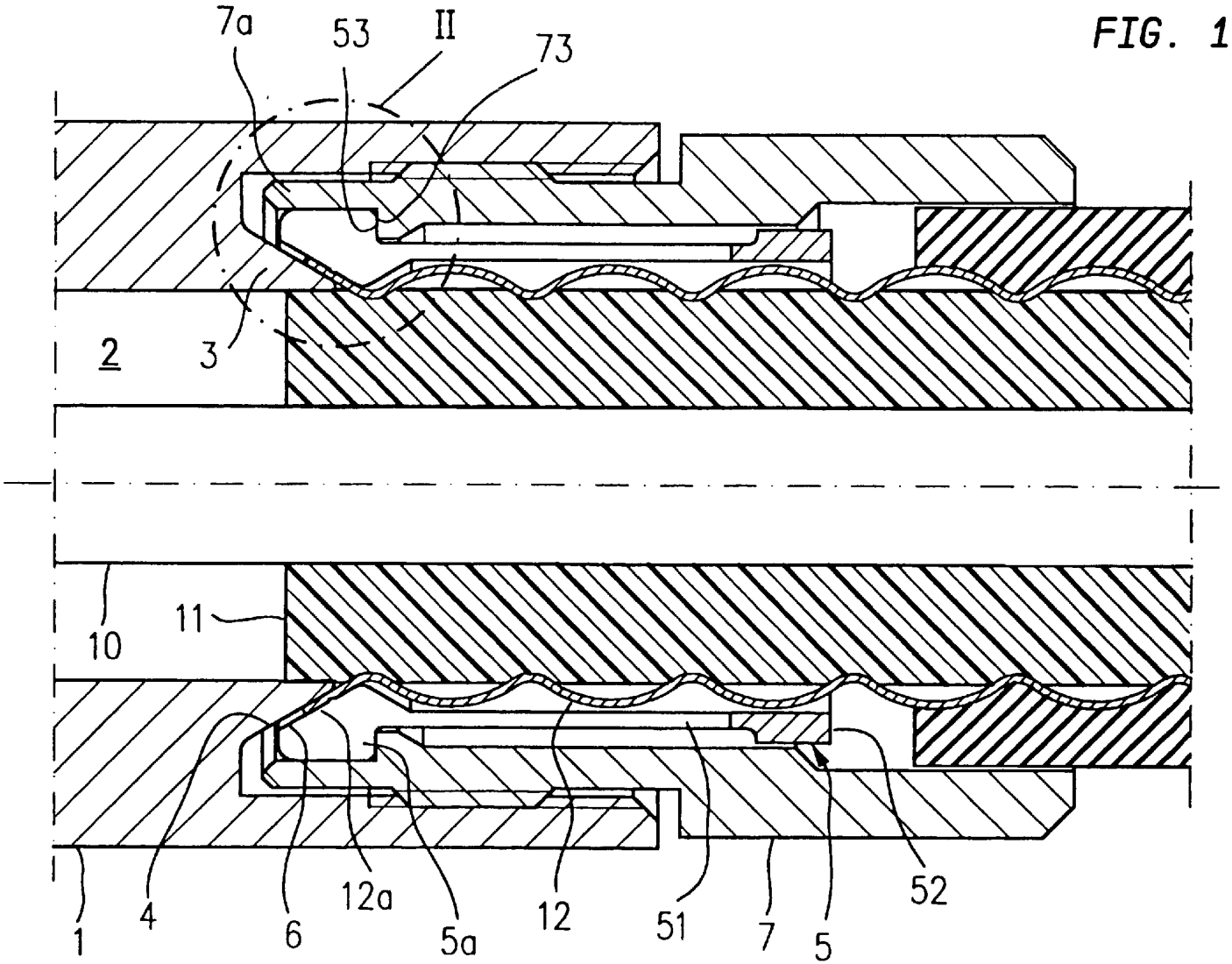
FIG. 1 is a longitudinal section of a first embodiment of a coaxial cable connector according to the present invention.

Turning now to the drawing, and in particular to FIG. 1, there is shown a longitudinal section of a first embodiment of a coaxial cable connector according to the present invention, including a head portion 1 which has a recess 2 formed at one end, i.e. in FIG. 1 the left-hand end area, with a ring-shaped protrusion 3. The protrusion 3 has a wedge-shaped cross section, i.e. a cone-shaped configuration, so that its radial outer ring surface, designated as first ring surface 4, extends on a conical outer surface area.

Received in the recess 2 is one end of a coaxial cable which includes an inner cable conductor 10 centered inside and insulated by a dielectric 11 from an outer cable conductor, e.g. an annular corrugated outer conductor 12. The outer cable conductor 12 has an end zone 12*a* which bears upon the first ring surface 4 and is thus contacted by the ring surface 4 from inside.

The coaxial cable connector further includes a cable restraint formed by a clamp bushing 5 and a pressure-applying member in the form of a hollow screw 7 which surrounds the cable and is fastened to the head portion 1. The clamp bushing 5 has a head portion confronting end 5*a* which exhibits a second ring surface 6 for clamping the end zone 12*a* of the outer conductor 12 from outside. The hollow screw 7 braces the clamp bushing 5 in axial direction to thereby effect a clamping of the end zone 12*a* of the outer conductor 12 between both ring surfaces 4, 6.

The clamp bushing 5 of the coaxial cable connector of FIG. 1 includes resilient tongues 51 formed through provision of axial slots which extend from the head portion confronting end 5*a* of the clamp bushing 5 and terminate in a massive ring section 52. The clamp bushing 5 is defined at its head portion confronting end 5*a* by an inner diameter which approximately corresponds to the outer diameter of the outer conductor 12 in the area of a wave trough. In the remaining section, the clamp bushing 5 has an inner diameter which slightly exceeds the outer diameter of the outer conductor 12. In proximity of its head portion confronting end 5*a*, the clamp bushing 5 is provided with a radially outwardly projecting annular shoulder 53 which forms the transition to the head portion confronting end 5*a* with increased outer diameter.

The hollow screw 7 has at its head portion confronting end a radially inwardly extending annular shoulder 73 which bears upon the radially outwardly projecting annular shoulder 53 of the clamp bushing 5. Continuing the annular shoulder 73 of the hollow screw 7 in head portion facing direction is a tubular section 7*a* which surrounds the head portion side end 5*a* of the clamp bushing 5.

When assembled, the respective ring-shaped end zone 12*a* of the outer conductor 12 is immovably clamped between both ring surfaces 4, 6 and is at the same time contacted from inside.

A characteristic feature of this type of clamping is that at least one of both ring surfaces 4, 6 is provided with at least one annular bead which juts outwardly the direction of the opposite surface of the end zone 12*a* of the outer conductor 12. In the non-limiting example of FIG. 2, the second ring surface 6 of the clamp bushing 5 is formed with an annular bead 30 which during assembly of the coaxial cable connector is pressed into the soft material, e.g. copper alloy, of the outer conductor 12 to effect an interconnecting engagement.

FIGS. 3*a*, 3*b*, 3*c* show respectively enlarged views of three different cross sectional profiles 30*a*, 30*b*, 30*c* of the annular bead 30. Common to all these cross sectional profiles is their undercut-free profile when viewed from the processing side, i.e. from left in FIGS. 2, 5 to 3*c*. The height H (see FIG. 3*a*) of the annular bead 30 is selected in accordance to standardized or otherwise predetermined tolerances of the wall thickness of the outer conductor 12 and the properties, especially the deformability of the outer conductor material.

Figure 4:
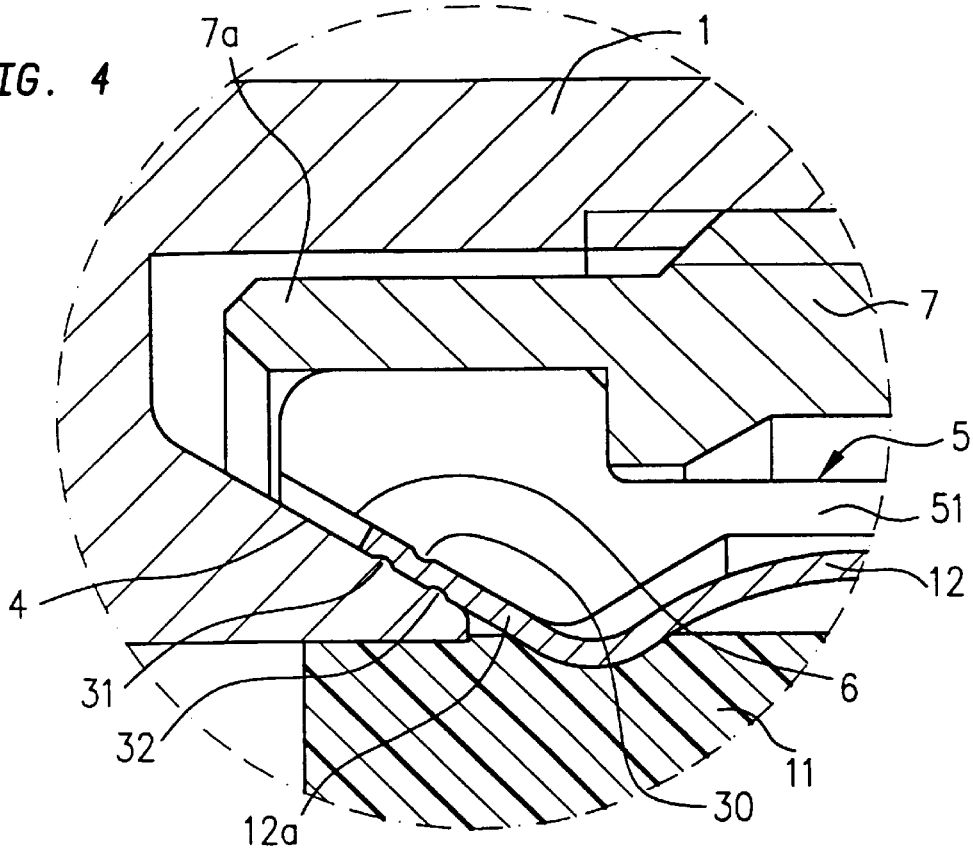
FIG. 4 is a cutaway view, on an enlarged scale of a variation of the coaxial cable connector according to FIG. 2.

FIG. 4 is a cutaway view, on an enlarged scale, of a variation of the coaxial cable connector according to FIG. 2, with the difference being that the first ring surface 4 of the head portion 1 is formed with two annular beads 31, 32 and the second ring surface 6 of the clamp bushing 5 is formed with one annular bead 30. Persons skilled in the art will understand that the arrangement of annular beads may also be vice versa, i.e. the first ring surface 4 may be formed with only one annular bead and second ring surface 6 may have two annular beads. In any event, the annular beads in the first and second ring surfaces 4, 6 are arranged in offset disposition to one another so as to lie on different diameters to thereby effect an tooth-like interlocking or form-fitting connection between the contacting components.

Figure 5:
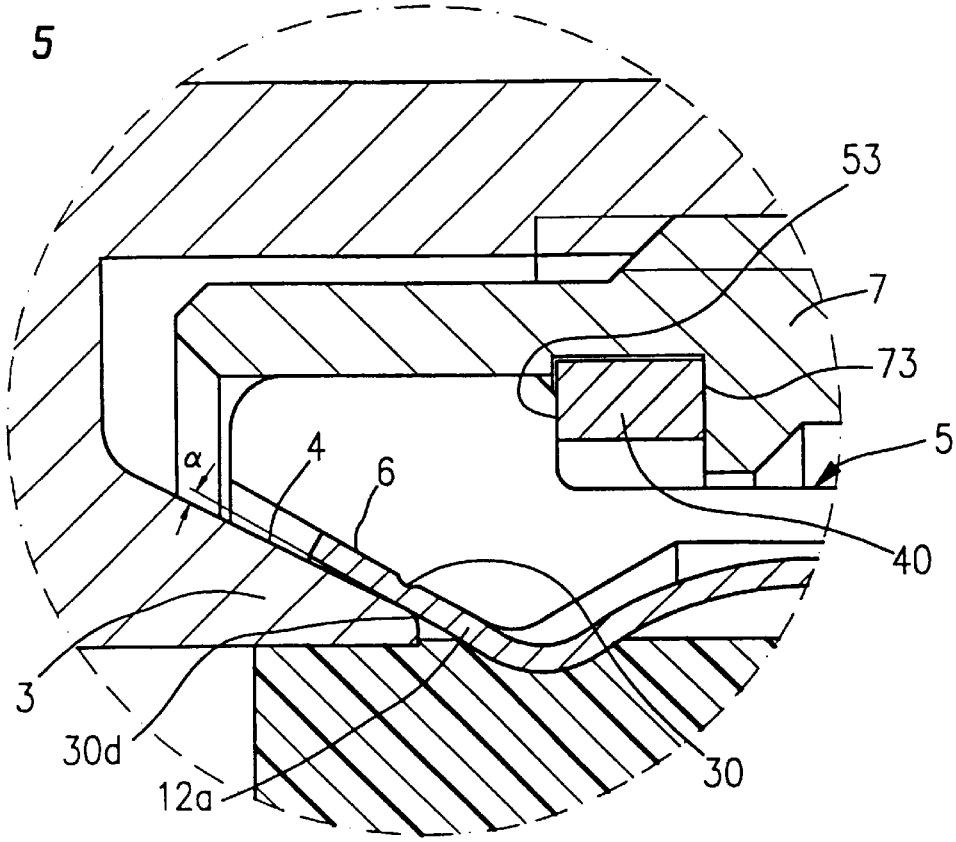
FIG. 5 is a cutaway view, on an enlarged scale of another variation of the coaxial cable connector according to FIG. 2.

FIG. 5 is a cutaway view, on an enlarged scale, of another variation of the coaxial cable connector according to FIG. 2, with the ring surfaces 4, 6 describing a small angle $\alpha$ a so as to effect between the ring surface 4 and the end zone 12*a* of the outer conductor 12 a narrower, annular contact area which in addition is situated on a smaller radius. The radius 30*d* of the ring-shaped protrusion 3 can thus simultaneously assume the function of an annular bead such as annular bead 32 in FIG. 4. Moreover, this variation of the connector includes the provision of a force-transmitting ring 40 which is preferably captivated in place between the outwardly projecting annular shoulder 53 of the clamp bushing 5 and the inwardly extending annular shoulder 73 of the hollow screw 7 and is made of wear-resistant material. In this manner, the risk that the hollow screw 7 conjointly moves the clamp bushing 5 when screwed in 7 is further reduced.

Figure 6:
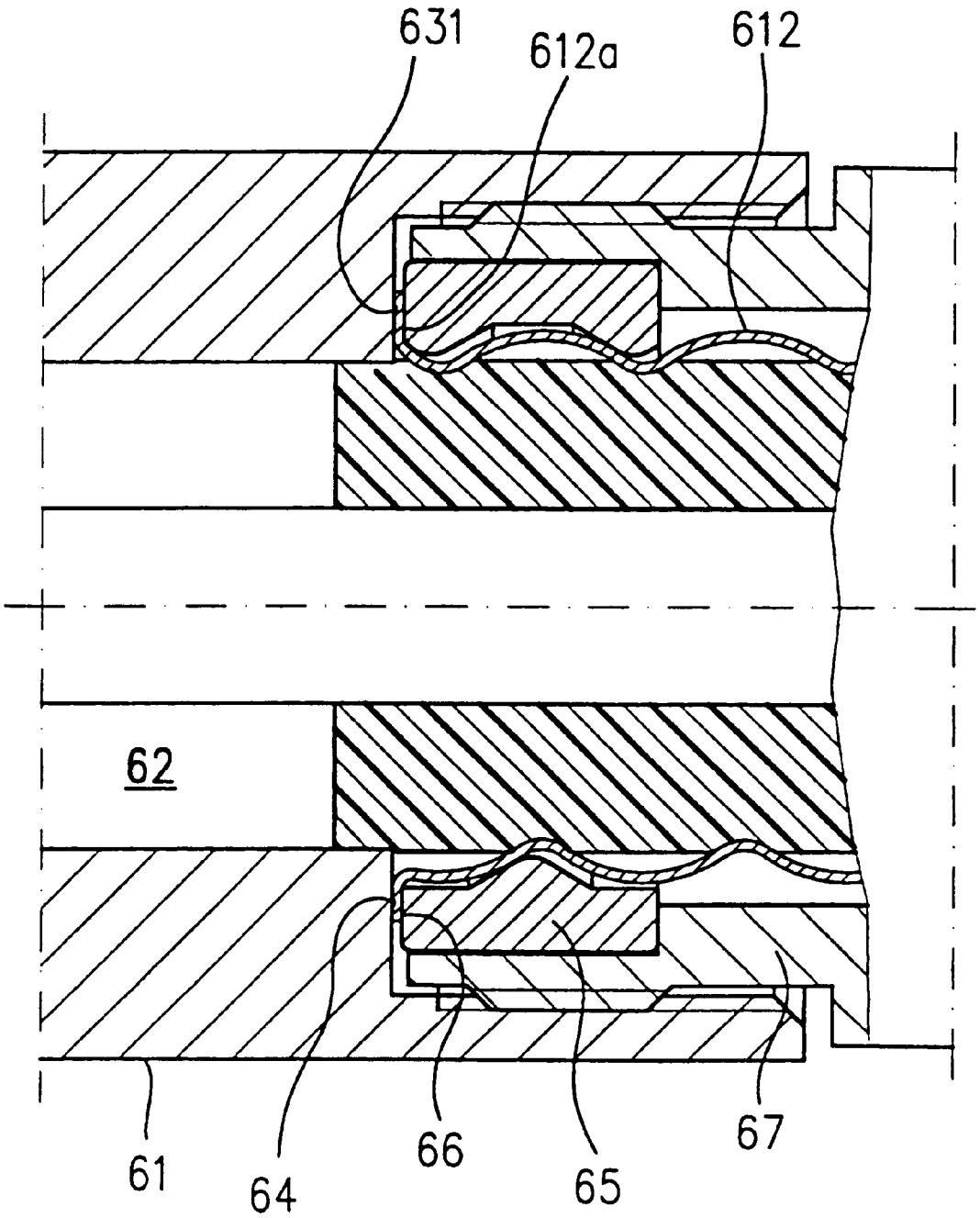
FIG. 6 is a longitudinal section of a second embodiment of a coaxial cable connector according to the present invention.

FIG. 6 is a longitudinal section of a second embodiment of a coaxial cable connector according to the present invention, adapted for use with a cable with helically corrugated outer conductor 612 which has an end zone 612*a* extending in a radial plane. The connector has a head portion 61 formed with a recess 62 and exhibiting a first ring surface 64 which interacts with the end zone 612*a* of the outer conductor 612 and also extends in a radial plane. The first ring surface 64 is formed with an annular bead 631 against which the end zone 612*a* of the outer conductor 612 is clamped by a second ring surface 66 positioned at an end face of a corrugated tubular nut 65 when a pressure-applying member in the form of a hollow screw 67 is threadably engaged in analogous manner as the hollow screw 7 in FIG. 2.

FIG. 7 is a longitudinal section of a third embodiment of a coaxial cable connector according to the present invention, with FIGS. 8*a*, 8*b* illustrating cutaway views, on an enlarged scale, of two variations designated by circle VIII in FIG. 7. This embodiment differs from the embodiments of FIGS. 1 to 5 in that the first ring surface 74 in the recess 72 of the head portion 71 and the second ring surface 76 of the clamp bushing 75 extend in radial planes. Securely clamped between the first ring surface 74 and the second ring surface 76 is the end zone 712*a* of outer conductor 712, with the end zone 712*a* being flanged outwardly at a right angle. Unlike conventional connectors having outwardly flanged end portions of the outer conductor when being assembled, the connector according to the present invention is so designed that at least one of the ring surfaces 74, 76 is formed with an annular bead. For example, as shown in FIG. 8*a*, the ring surface 76 of the clamp bushing 75 may be formed with an annular bead 30*e*, or, as shown in FIG. 8*b*, the ring surface 74 of the head portion 71 may be formed with an annular bead 30*f* in analogous fashion as referred to e.g. in the embodiment of FIG. 2.

FIG. 9 is a longitudinal section of a modification of the coaxial cable connector of FIG. 7, with the difference being that the first ring surface 94 defines with the second ring surface 96 lying in a radial plane, a small angle α so that the first ring surface 94 constitutes the outer surface area of a greatly obtuse-angled cone. The axial force as transmitted by the hollow screw 97 onto the clamp bushing 95 and transmitted by the clamp bushing 95 onto the clamped end zone 912*a* of the outer conductor 912, effects as a consequence of a tilting of the first ring surface 94 in the contacting zone a surface pressure which decreases with increasing radius so that the ring-shaped contacting zone is overall of narrower configuration and exhibits a smaller mean diameter compared to the embodiment of FIG. 7.

Figure 10:
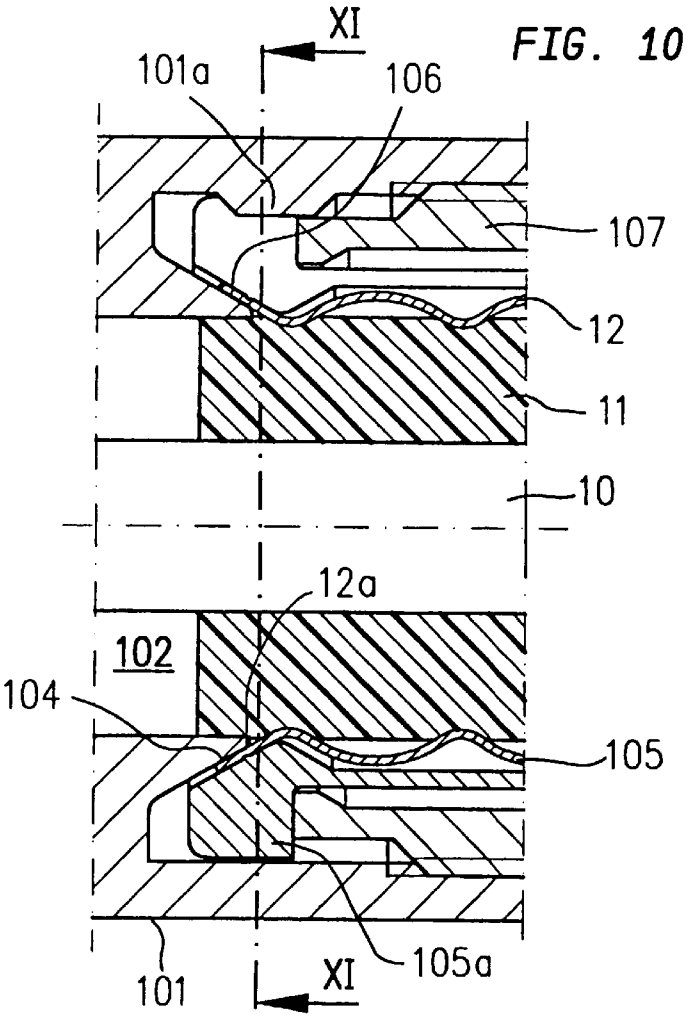
FIG. 10 is a longitudinal section of a fourth embodiment of a coaxial cable connector according to the present invention, taken along the line X—X in FIG. 11.
Figure 11:
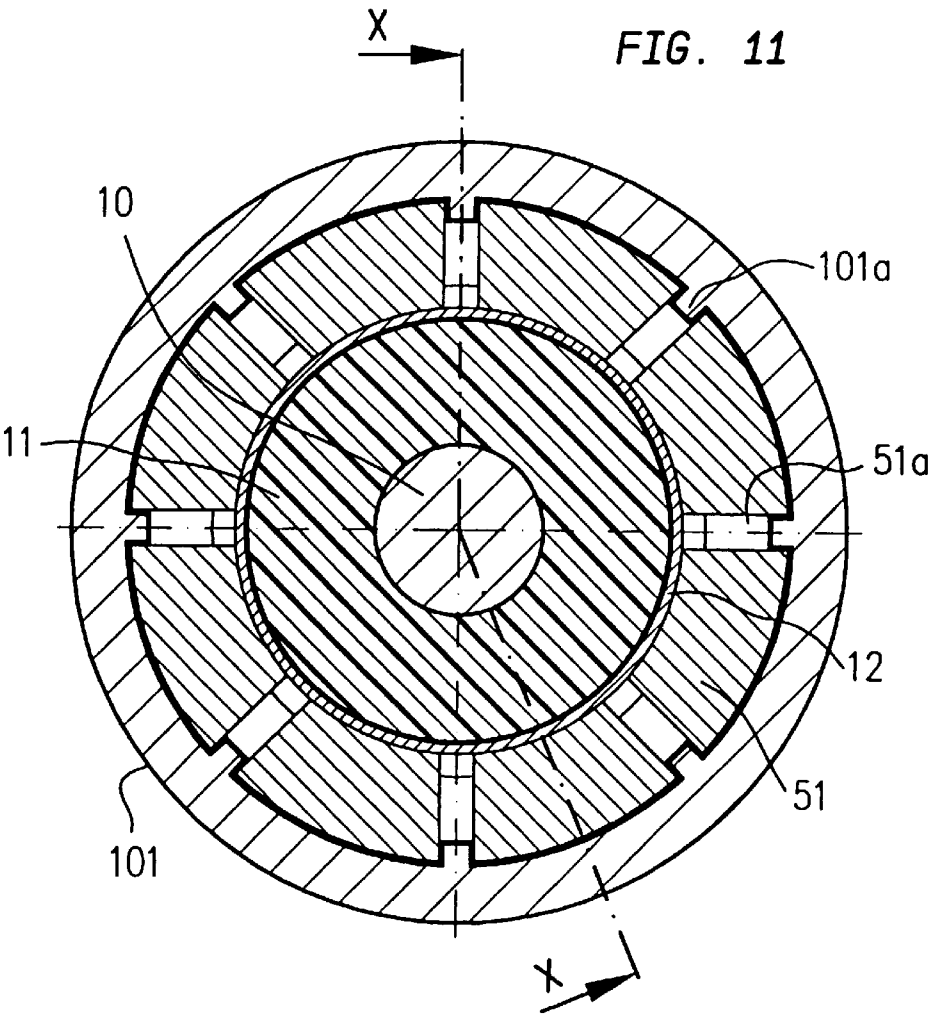
FIG. 11 is a cross sectional view of the coaxial cable connector, taken along the line XI—XI in FIG. 10.

FIG. 10 is a longitudinal section of a fourth embodiment of a coaxial cable connector according to the present invention, taken along the line X—X in FIG. 11 which is a cross sectional view of the coaxial cable connector, taken along the line XI—XI in FIG. 10. The contacting between the outer conductor 12 and the head portion 101 as well as the clamping by the clamp bushing 105 corresponds to the embodiment of FIG. 2. Unlike in the foregoing embodiments, the clamp bushing 105 is however axially displaceable within the head portion 101 but secured against rotation in circumferential direction. The securement against rotation is effected by forming the inner wall of the recess 102 of the head portion 101 in proximity to the head portion facing end of the clamp bushing 105 with inwardly directed wedges 101*a* which engage in slots 51*a* between the tongues 51 of the clamp bushing 105, as best seen in FIG. 11. Assembly of the connector proceeds as follows: After placing the clamp bushing 105 and the hollow screw 107 over the cable end, the head portion 101 is pushed over the cable end and, if necessary, turned to such an extent until the wedges 101*a* are aligned with the slots 51*a* extending between the tongues 51 of the clamp bushing 105. The head portion 101 can then be pushed onto the cable into the position shown in FIG. 10. Subsequently, the hollow screw 107 is tightened to thereby securely clamp the end zone 12*a* of the outer conductor 12 between the first ring surface 104 and the second ring surface 106, in like manner as described e.g. in connection with FIG. 2. The enlarged end zone 105*a* of the clamp bushing 105 bears upon the inside wall of the recess 102 and is prevented from migrating radially outwards. The inside wall of the recess 102 thus assumes the function of the section 7*a* of the clamp bushing 7, e.g. in FIG. 1. Although not clearly shown in FIG. 10 as a result of the utilized scale, persons skilled in the art will understand that at least one of the ring surfaces 104, 106 is formed with at least one annular bead in a manner as previously described.

While the invention has been illustrated and described as embodied in a connector for coaxial cables, it is not intended to be limited to the details shown since various modifications and structural changes may be made without departing in any way from the spirit of the present invention.

What is claimed as new and desired to be protected by Letters Patent is set forth in the appended claims:

What is claimed is:

1. A connector for a coaxial cable, comprising:

a head portion defining a longitudinal axis and having a recess which has one end formed with a first ring surface for establishing a contact from inside with an end zone of an outer cable conductor; and a restraint mechanism for the cable, said restraint mechanism including a clamp bushing having a head portion end formed with a second ring surface for clamping the end zone of the outer cable conductor from outside, and a pressure-applying member surrounding the cable and fastened to the head portion, said pressure-applying member forcing the clamp bushing in the axial direction against the first ring surface to thereby clamp the end zone of the outer cable conductor between the first and second ring surfaces, wherein at least one of the first and second ring surfaces is formed with at least one annular bead jutting outwards in the direction of a respective area of the end zone of the outer cable conductor and defined by a height of approximately 5 to 30% of a wall thickness of the outer cable conductor.

2. The connector of claim 1 wherein the first and second ring surfaces are each positioned in a radial plane.

3. The connector of claim 1 wherein the first and second ring surfaces lie on conical outer surfaces defining a generatrix intersecting the longitudinal axis in a point at the cable end of the ring surfaces.

4. The connector of claim 1 wherein the first and second ring surfaces define an angle in a range of greater 0° to approximately 5°.

5. The connector of claim 1 wherein at least one of the first and second ring surfaces is formed with at least two annular beads which extend coaxially to one another and exhibit different diameters.

6. The connector of claim 1 wherein the first and second ring surfaces are formed with at least one annular bead, with the annular bead of the first ring surface and the annular bead of the second ring surface exhibiting different diameters.

7. The connector of claim 1 wherein the annular bead has a cross sectional profile which is free from any undercuts as viewed in the direction of formation.

8. The connector of claim 1 wherein the clamp bushing is so received in the recess of the head portion as to be secured against rotation but allowed to move in axial direction.

9. The connector of claim 1 wherein the clamp bushing is secured against rotation in the area of the head portion side end thereof through interconnecting engagement with an inner wall surface of the recess of the head portion.

10. The connector of claim 1 wherein the clamp bushing is formed with slots extending from the head portion side end thereof for forming resilient tongues, said clamp bushing having at the head portion side end an inner diameter which substantially corresponds to an outer diameter of the outer cable conductor in the area of a wave trough and having in the remaining portion an inner diameter which substantially corresponds to a greatest outer diameter of the outer cable conductor.

11. The connector of claim 1 wherein the clamp bushing is formed from an axially split profiled corrugated tubular-shaped sleeve.

12. The connector of claim 1 wherein the clamp bushing is formed from a profiled corrugated tubular-shaped nut.

13. The connector of claim 1 wherein the pressure-applying member is formed as a hollow screw which is turned into the recess of the head portion and at least partially overlaps the clamp bushing.

14. The connector of claim 13 wherein the hollow screw has a head portion side end formed with an element selected from the group consisting of annular end face and radially inwardly extending annular shoulder which is in form-fitting engagement with an annular shoulder radially projecting outwards from the outer circumference of the clamp bushing in proximity of the head portion side end thereof.

15. The connector of claim 14, and further comprising a force-transmitting ring of wear-resistant material positioned between the element and the outwardly projecting annular shoulder of the clamp bushing.

* * * * *